US009297522B2

(12) United States Patent
Behr et al.

(10) Patent No.: US 9,297,522 B2
(45) Date of Patent: Mar. 29, 2016

(54) LIGHTING DEVICE

(71) Applicant: OSRAM GmbH, Munich (DE)

(72) Inventors: Gerhard Behr, Altheim (DE); Stephan Schwaiger, Ulm (DE); Philipp Helbig, Heidenheim (DE)

(73) Assignee: OSRAM GmbH, Munich (DE)

( * ) Notice: Subject to any disclaimer, the term of this patent is extended or adjusted under 35 U.S.C. 154(b) by 27 days.

(21) Appl. No.: 14/376,903

(22) PCT Filed: Feb. 13, 2013

(86) PCT No.: PCT/EP2013/052878

§ 371 (c)(1),
(2) Date: Aug. 6, 2014

(87) PCT Pub. No.: WO2013/127632

PCT Pub. Date: Sep. 6, 2013

(65) Prior Publication Data

US 2014/0376232 A1 Dec. 25, 2014

(30) Foreign Application Priority Data

Feb. 27, 2012 (DE) ..... 10 2012 202 933

(51) Int. Cl.
*F21V 19/00* (2006.01)
*F21S 8/10* (2006.01)
(Continued)

(52) U.S. Cl.
CPC ..... *F21V 19/002* (2013.01); *F21K 9/50* (2013.01); *F21S 48/1104* (2013.01);
(Continued)

(58) Field of Classification Search
CPC ..... F21V 29/22; F21V 17/02; F21V 19/0055; F21V 17/16; F21V 29/70; F21V 29/763; F21V 7/06; F21V 17/164; F21V 19/045; F21V 17/12; F21V 19/002; F21S 48/1104; F21S 48/1305; F21S 48/328; F21S 48/1159; F21K 9/50; F21Y 2101/025; F21Y 2101/02
See application file for complete search history.

(56) References Cited

U.S. PATENT DOCUMENTS 8,197,109 B2 * 6/2012 Iwasaki ..... F21S 48/1159 362/298
8,602,608 B2 * 12/2013 Derks ..... F21V 15/01 362/249.02

(Continued)

FOREIGN PATENT DOCUMENTS

DE 102007038786 A1 2/2009
DE 102007050893 A1 4/2009

(Continued)

OTHER PUBLICATIONS

English abstract of JP 2010182486 A of Aug. 19, 2010.
English abstract of DE 102007038786 of Feb. 12, 2009.
International Search Report issued in the corresponding PCT application No. PCT/EP2013/052878, dated Jun. 6, 2013.

*Primary Examiner* — Bao Q Truong
(74) *Attorney, Agent, or Firm* — Viering, Jentschura & Partner MBB

(57) ABSTRACT

A lighting device may include a semiconductor light source module, an optical unit, and a common support for the semiconductor light source module and the optical unit. The optical unit is mounted on a front side of the support and has at least one dowel, which extends into a precisely fitting hole in the semiconductor light source module. The semiconductor light source module rests on a rear side of the support. The at least one dowel projects through an aperture in the support and extends into the precisely fitting hole in the semiconductor light source module. The at least one dowel forms a shoulder, which rests on a supporting surface of the semiconductor light source module that rests on the rear side of the support.

12 Claims, 8 Drawing Sheets

(51) Int. Cl.

| | |
|---|---|
| ***F21V 7/06*** | (2006.01) |
| ***F21V 17/02*** | (2006.01) |
| ***F21V 17/16*** | (2006.01) |
| ***F21V 19/04*** | (2006.01) |
| ***F21K 99/00*** | (2010.01) |
| ***F21V 17/12*** | (2006.01) |
| ***F21V 29/70*** | (2015.01) |
| ***F21V 29/76*** | (2015.01) |
| *F21Y 101/02* | (2006.01) |

(52) U.S. Cl.

CPC ..... *F21S 48/1159* (2013.01); *F21S 48/1305* (2013.01); *F21V 7/06* (2013.01); *F21V 17/02* (2013.01); *F21V 17/12* (2013.01); *F21V 17/16* (2013.01); *F21V 17/164* (2013.01); *F21V 19/0055* (2013.01); *F21V 19/045* (2013.01); *F21V 29/70* (2015.01); *F21V 29/763* (2015.01); *F21S 48/328* (2013.01); *F21Y 2101/02* (2013.01); *F21Y 2101/025* (2013.01)

(56) References Cited

U.S. PATENT DOCUMENTS

| | | | | |
|---|---|---|---|---|
| 8,967,843 | B2 * | 3/2015 | Jackl | F21S 48/1109 362/246 |
| 8,998,463 | B2 * | 4/2015 | Matsumoto | B60Q 1/0094 362/487 |
| 9,157,612 | B2 * | 10/2015 | Alfier | F21V 29/004 |
| 2007/0139946 | A1 | 6/2007 | Basile et al. | |
| 2008/0117647 | A1 | 5/2008 | Behr et al. | |
| 2009/0168428 | A1 | 7/2009 | Huang | |
| 2010/0302777 | A1 | 12/2010 | Knoll et al. | |

FOREIGN PATENT DOCUMENTS

| | | | |
|---|---|---|---|
| EP | 1467146 | A2 | 10/2004 |
| EP | 1767967 | A2 | 3/2007 |
| JP | 2010182486 | A | 8/2010 |
| WO | 2006066530 | A1 | 6/2006 |

* cited by examiner

LIGHTING DEVICE

RELATED APPLICATIONS

The present application is a national stage entry according to 35 U.S.C. §371 of PCT application No.: PCT/EP2013/052878 filed on Feb. 13, 2013, which claims priority from German application No.: 10 2012 202 933.8 filed on Feb. 27, 2012, and is incorporated herein by reference in its entirety.

TECHNICAL FIELD

Various embodiments relate to a lighting device.

BACKGROUND

A lighting device of this type is disclosed, for example, in WO 2006/066530 A1. This document describes a lighting device having a semiconductor light source module and an optical unit, which are mounted on the front side of a common support. In particular, the optical unit has a plurality of dowels, which extend through precisely fitting holes in the semiconductor light source module and in the support.

The design disclosed in WO 2006/066530 A1 does not permit simple replacement of the semiconductor light source module.

SUMMARY

Various embodiments provide a generic type of lighting device which, in a simple way, permits replacement of the semiconductor light source module and permits adjustment of the semiconductor light source module with respect to the optical unit.

The lighting device according to various embodiments has a semiconductor light source module and an optical unit and also a common support for the semiconductor light source module and the optical unit, wherein the optical unit is mounted on a front side of the support by means of at least one dowel, which extends into a precisely fitting hole of the semiconductor light source module. According to various embodiments, the semiconductor light source module rests on a rear side of the support, opposite the front side, and the at least one dowel projects through an aperture in the support and extends into the precisely fitting hole of the semiconductor light source module, wherein the at least one dowel forms a shoulder, which rests on a supporting surface of the semiconductor light source module that rests on the rear side of the support. The term "precisely fitting hole" means that the diameter of the hole is matched precisely to the diameter of the section of the at least one dowel which extends in the hole. This means that the diameter of the precisely fitting hole in the semiconductor light source module corresponds to the diameter of the section of the at least one dowel that is arranged in the precisely fitting hole.

Because of the above-described specific design of the at least one dowel, the aperture in the support and the precisely fitting hole in the semiconductor light source module, as well as the arrangement of optical unit and semiconductor light source module on different sides of the support, in the lighting device according to various embodiments the semiconductor light source module can be replaced in a simple way without the optical unit or other parts of the lighting device according to various embodiments having to be disassembled in advance for this purpose. In addition, the at least one dowel, in interaction with the precisely fitting hole in the semiconductor light source module, permits exact alignment and adjustment of the optical unit with respect to the semiconductor light source module. In particular, by means of the shoulder of the dowel, the height of the optical unit above the supporting surface of the semiconductor light source module is defined and, by means of the precisely fitting hole in the semiconductor light source module, the alignment and position of the optical unit with respect to the semiconductor light source module in a plane parallel to the supporting surface is defined.

Advantageously, the at least one dowel is formed in one piece with the optical unit. As a result, the at least one dowel can be used not only for adjustment but also as a means for fixing the optical unit to the semiconductor light source module. In addition, fabrication is simplified as a result, since the dowel can be produced simultaneously with the optical unit in the same fabrication step.

According to various embodiments, the at least one dowel is designed to be hollow and has a screw thread to receive a screw. As a result, the at least one dowel can additionally also be used for fixing the optical unit to the semiconductor light source module.

According to various embodiments, the at least one dowel projects out of the hole in the semiconductor light source module, out of a side of the semiconductor light source module that faces away from the supporting surface, and the section of the dowel projecting out of the hole in the semiconductor light source module is provided with a screw thread for a nut. This embodiment likewise offers the advantages of the above-described preferred exemplary embodiment of the present disclosure that were mentioned in the previous paragraph.

Advantageously, the lighting device according to various embodiments has first fixing means, which are provided in order to fix the supporting surface of the semiconductor light source module to the rear side of the support. For example, the first fixing means can be formed as a screw connection between semiconductor light source module and optical unit or as a clamping device, which forces the semiconductor light source module with its supporting surface against the rear side of the support. The screw connection has the advantage as compared with the clamping device that, with the aid thereof, a comparatively high contact pressure between semiconductor light source module and support can be achieved, and therefore good thermal coupling between semiconductor light source module and support is made possible.

Advantageously, in the lighting device according to various embodiments there are second fixing means, which are used to fix the optical unit to the support. These second fixing means permit fixing of the optical unit to the support independently of the at least one dowel and ensure that, when the semiconductor light source module is disassembled, the connection between optical unit and support is maintained. The second fixing means are preferably formed as a snap-in or latching connection between optical unit and support. The snap-in or latching connection permits fixing of the optical unit to the support in an already coarsely adjusted alignment.

The support of the lighting device according to various embodiments advantageously has a cutout to receive a section of the semiconductor light source module that is provided with semiconductor light sources. This makes it possible for the section of the semiconductor light source module that is fitted with the semiconductor light sources to extend as far as the front side of the support, so that the light emitted by the semiconductor light sources strikes the optical unit arranged on the front side of the support.

Preferably, the support of the lighting device according to various embodiments is formed as a cooling element. As a result, effective cooling of the semiconductor light source module can be ensured, since the heat generated by the semiconductor light source module is dissipated to the surroundings by means of the cooling element.

The semiconductor light source module of the lighting device according to various embodiments has a heat sink, on which the semiconductor light sources are arranged. In addition, the supporting surface of the semiconductor light source module is formed as a constituent part of the heat sink. As a result, good thermal coupling of the semiconductor light sources to the heat sink is guaranteed and it is ensured that the heat generated by the semiconductor light sources is dissipated via the heat sink and the supporting surface to the support, preferably formed as a cooling element. In this connection, the above-described screw connections between semiconductor light source module and support by means of the at least one dowel offer the possibility of producing a high contact pressure between the supporting surface of the semiconductor light source module and the rear side of the support and, as a result, of achieving good thermal coupling between semiconductor light source module and support.

The heat sink preferably consists of metal, for example copper or aluminum, or ceramic, for example aluminum nitride, in order to ensure good thermal conductivity. The support formed as a cooling element preferably consists of metal, for example aluminum, in order to ensure good thermal conductivity, and is preferably provided with cooling ribs in order to achieve a large surface which, for the purpose of cooling, is in contact with the surrounding air.

Advantageously, the semiconductor light source module of the lighting device according to various embodiments has electric components of an operating device for the semiconductor light sources. As a result, the semiconductor light source module can be directly connected to the mains voltage, for example the on-board power supply of a motor vehicle. The electric components of the operating device are preferably arranged on the heat sink of the semiconductor light source module, in order to be able to dissipate the heat generated by the electric components of the operating device, likewise via the heat sink, to the support formed as a cooling element.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
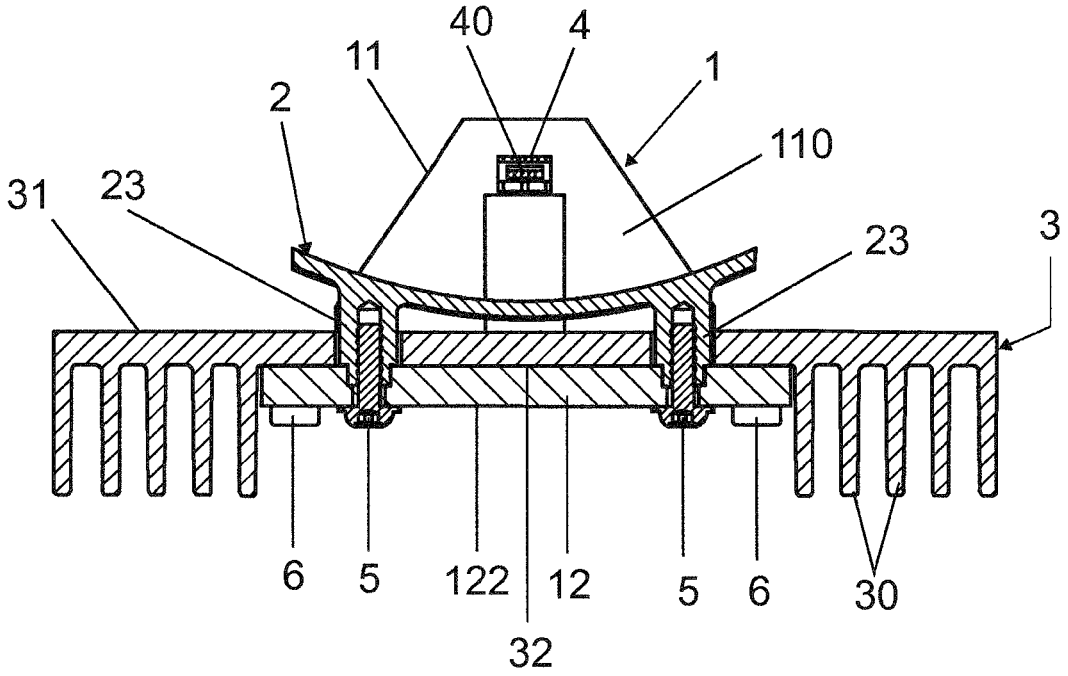
FIG. 1 shows a longitudinal section through the lighting device according to the preferred embodiment of the disclosure in a schematic illustration with section plane in the area of two dowels.
Figure 2:
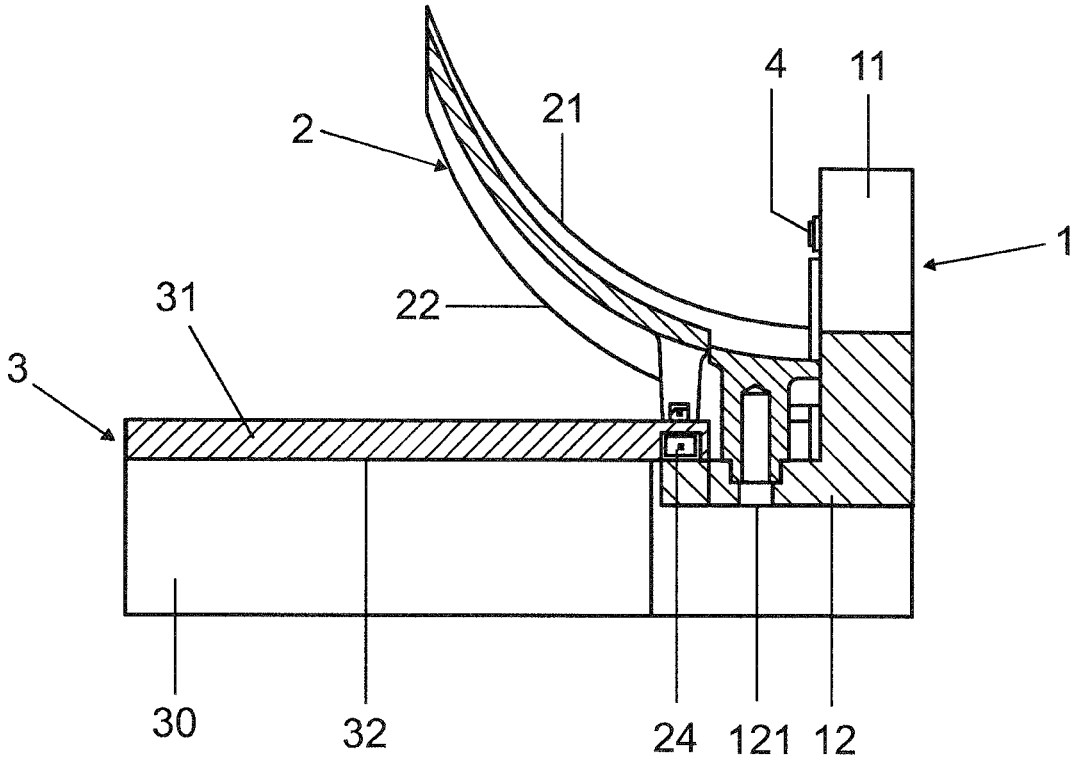
FIG. 2 shows a cross section through the lighting device depicted in FIG. 1 in a schematic illustration with section plane in the area of a dowel.
Figure 3:
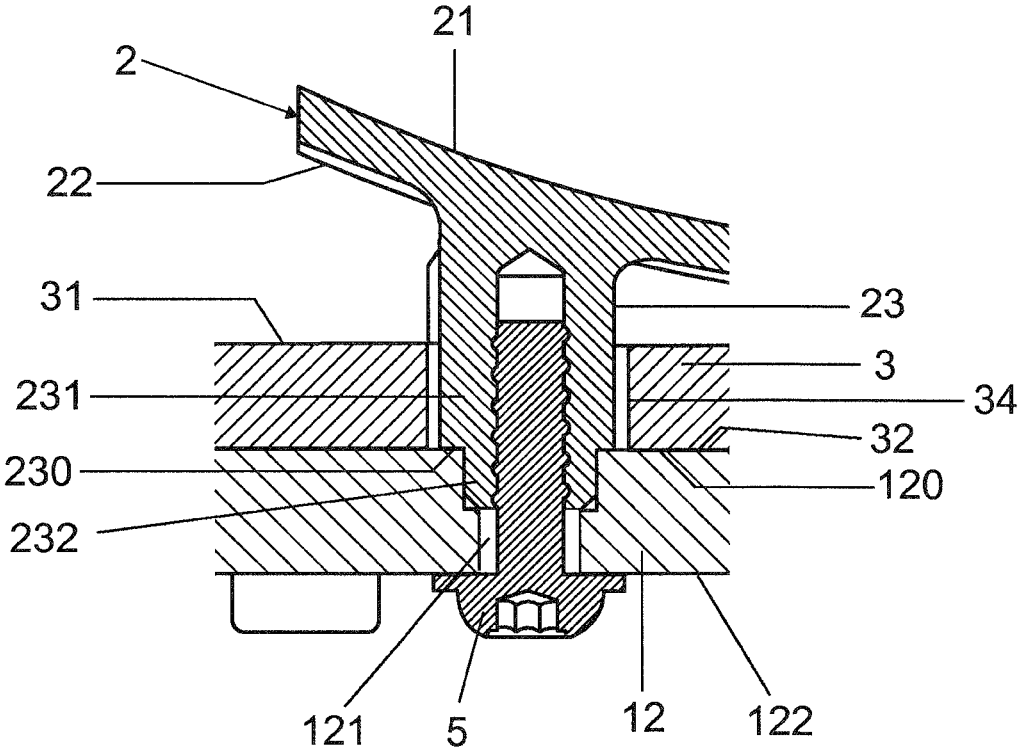
FIG. 3 shows a detail from FIG. 1 with an enlarged illustration of a dowel.
Figure 4:
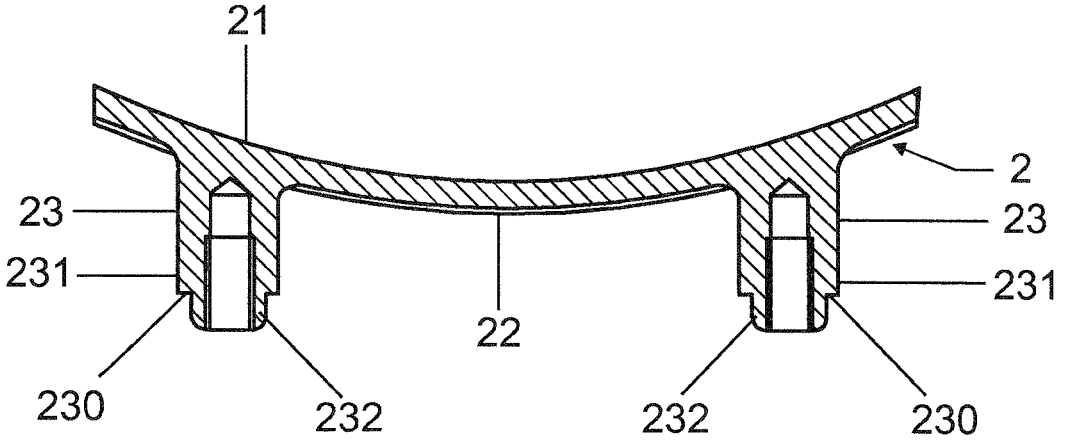
FIG. 4 shows a longitudinal section through the optical unit of the lighting device depicted in FIG. 1.
Figure 5:
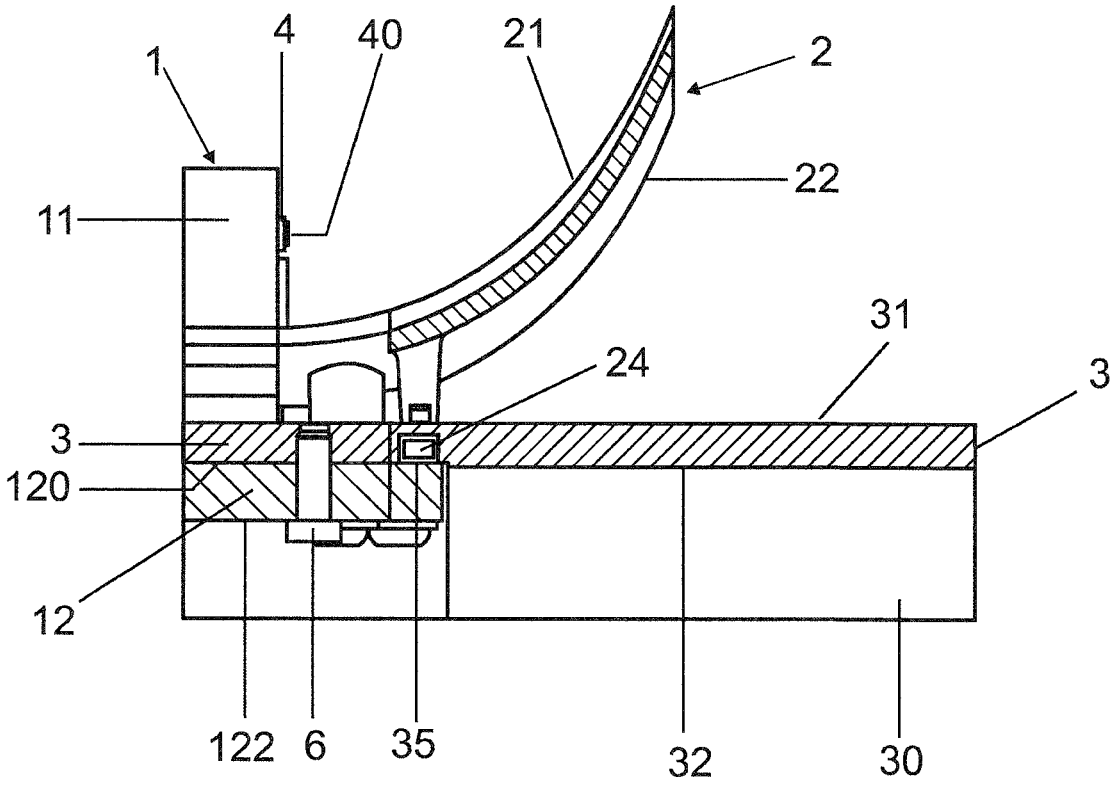
FIG. 5 shows a cross section through the lighting device depicted in FIG. 1 in a schematic illustration with section plane in the area of the fixing of semiconductor light source module and support.
Figure 6:
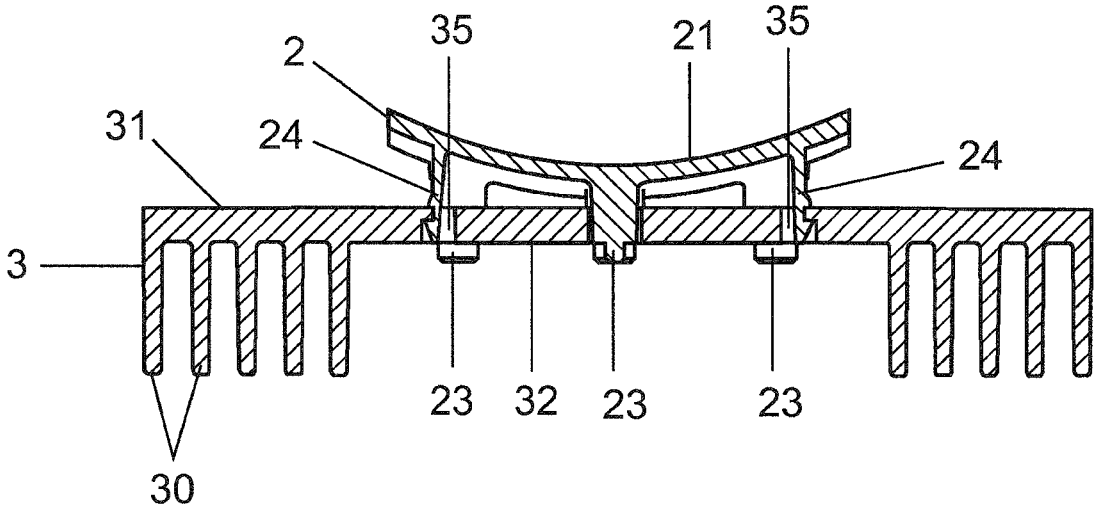
FIG. 6 shows a longitudinal section through the lighting device depicted in FIG. 1 in a schematic illustration with section plane in the area of the fixing of optical unit and support.
Figure 7:
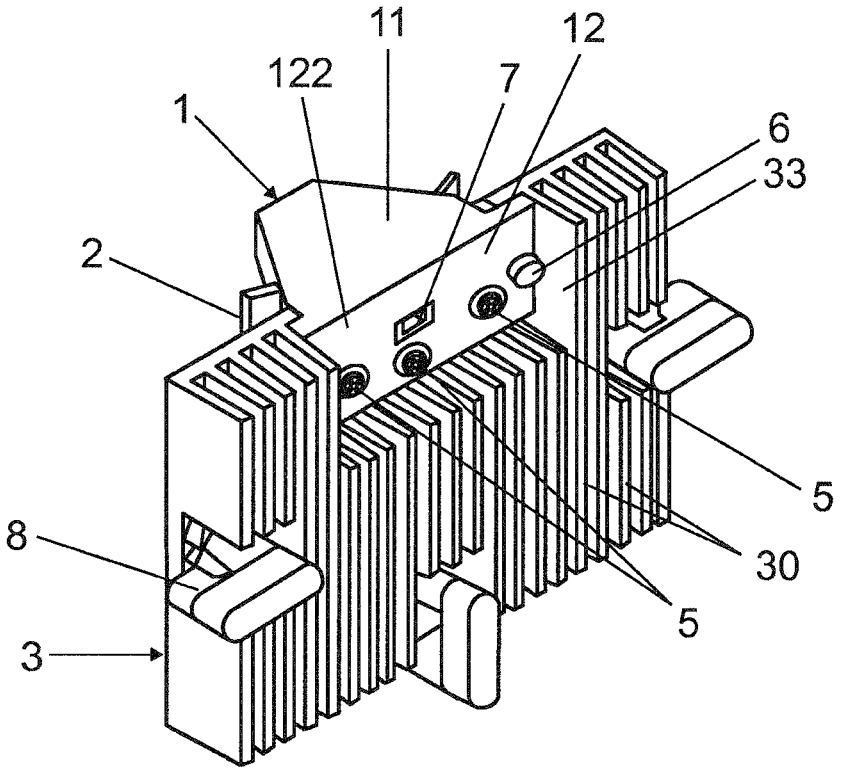
FIG. 7 shows a rear view of the lighting device depicted in FIG. 1 in a perspective illustration.
Figure 8:
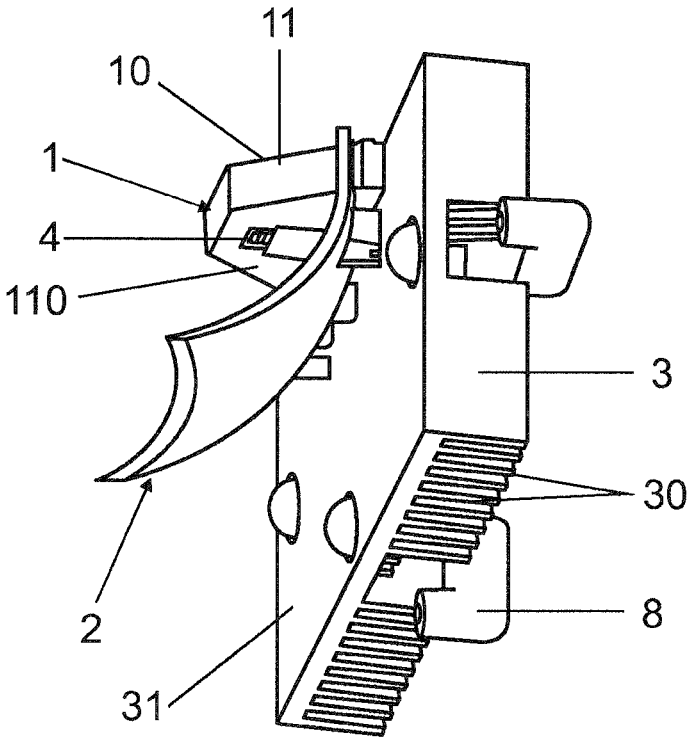
FIG. 8 shows a front view of the lighting device depicted in FIG. 1 in a perspective illustration.

The lighting device illustrated in FIGS. 1 to 8 is a lighting device which is provided for use in the front headlight of a motor vehicle. This lighting device has, as essential components, a semiconductor light source module 1, an optical unit 2 and a common support 3 for the semiconductor light source module 1 and the optical unit 2.

The support 3 is formed by a rectangular aluminum plate, which has a flat front side 31 and a rear side 32 and on the rear side 32 of which there are arranged cooling ribs 30. On one long edge, the support 3 has a cutout 33 to receive the semiconductor light source module 1. The support 3 serves as a cooling element for the semiconductor light source module 1 and will therefore also occasionally be designated below as cooling element 3. In the support, three apertures 34 are made for respectively one dowel 23 of the optical unit 2. The three apertures 34 in the support 3 are arranged in the manner of a triangle on the front side 31 of the support 3. This means that three apertures 34 form the corner points of an imaginary triangle on the front side 31 of the support 3.

The optical unit 2 is formed as a reflector, in order to reflect the light emitted by the semiconductor light source module 1. The optical unit 2 is shell-like, formed with a substantially parabolic curvature. It has a light-reflecting surface 21, which faces the semiconductor light sources of the semiconductor light source module 1. The light-reflecting surface 21 is arranged on the inside of the shell-like optical unit 2. Integrally molded on an outer side 22 of the shell-like optical unit 2, facing away from the inner side 21, are three hollow dowels 23, which are each provided with a screw thread in their interiors and which are used for the adjustment of the physical position and orientation of the optical unit 2 with respect to the semiconductor light source module 1. The third dowel 23, illustrated only very schematically in FIG. 6, has the same design as the two other dowels 23 illustrated in FIG. 1. The optical unit 2 is arranged on the front side 31 of the support 3 and the three dowels 23 thereof each project through an aperture 34 in the support 3. The three dowels 23 each have two sections 231, 232 with a different external diameter. The first section 231 is integrally molded on the outer side 22 of the optical unit 2, and the second section 232 adjoins the first section 231 immediately and forms the free end of the respective dowel 23. At the transition from the first section 231 to the second section 232, each dowel 23 forms a shoulder 230, which in each case is caused by the different external diameters of the two sections 231, 232. The external diameter of the second section 232 in each dowel 23 is smaller than the external diameter of the first section 231 thereof. The first section 231 of the dowels 23 in each case projects through the corresponding aperture 34 in the support 3, so that the second section 232 of the dowels 23 in each case projects out on the rear side 32 of the support 3. In order to fix the optical unit 2 to the support 3, the optical unit 2 is equipped with two springy snap-in hooks 24, which are integrally molded on the outer side 22 of the optical unit 2 and each latch behind a cutout 35 on the rear side 32 of the support 3. The fixing of the optical unit 2 by means of the snap-in hooks 24 is illustrated schematically in FIGS. 5 and 6.

The semiconductor light source module 1 has a heat sink 10 made of aluminum with a first section 11 formed in the manner of a wedge, on the surface 110 of which there is mounted a mounting plate 4 having five light-emitting diode chips 40 arranged in a row. The light-emitting diode chips 40 emit white light during their operation. The mounting plate 4 is formed, for example, as a metal-core circuit board. In addition, electric components (not depicted) of an operating device for the light-emitting diode chips 40 are mounted on a surface of the heat sink 10. The first section 11 of the semiconductor light source module 10 is arranged in the cutout 33 of the support 3 and projects beyond the front side 31 of the support 3, so that the light-emitting diode chips 40 are arranged substantially at the focus of the parabolic optical unit 2, and the light emitted by the light-emitting diode chips 40 strikes the light-reflecting inner side 21 of the optical unit 2. The heat sink 10 also has a second section 12, formed in the manner of a plate, which is angled over at right angles to the first section 11. The second, plate-like section 12 of the heat sink 10 forms a supporting surface 120, which rests on the rear side 32 of the support 3. In the second, plate-like section 12 of the heat sink 10 there are arranged three precisely fitting holes 121 for each one of the three dowels 23 of the optical unit 2. The diameter of the holes 121 is in each case matched to the external diameter of the second section 232 of the corresponding dowels 23, so that the second section 232 of the dowels 23 in each case fits exactly into the corresponding hole 121. In particular, the diameter of the holes 121 is thus smaller than the external diameter of the first section 231 of the dowels 23. The second section 232 of the three dowels 23 in each case extends into the corresponding hole 121 in the second, plate-like section 12 of the heat sink 10, so that the shoulder 230 of the respective dowel 23 rests on the supporting surface 120 of the second, plate-like section 12 of the heat sink 10. This fact is illustrated schematically in FIG. 3. The shoulder 230 of the dowels 23 therefore determines the height of the optical unit 2 above the supporting surface 120 of the second, plate-like section 12 of the heat sink 10, and therefore the vertical position of the optical unit 2 with respect to the light-emitting diode chips 40. The physical position and orientation of the optical unit 2 with respect to the light-emitting diode chips 40 in directions parallel to the supporting surface 120 is defined by the position of the three holes 121. Since the external diameter of the second section 232 of the three dowels 23 is respectively matched to the diameter of the corresponding hole 121, the dowels 23 are each arranged without play in the corresponding hole 121. In order to fix the optical unit 2 to the semiconductor light source module 1, from the rear side 32 of the support 3 and, respectively, from a rear side 122, facing away from the supporting surface 120, of the second section 12 of the heat sink 10, in each case a screw 5 is inserted into each of the three holes 121 and screwed into the corresponding hollow dowel 23 by using the screw thread. By means of the screws 5, the shoulder 230 of the corresponding dowel 23 is forced against the supporting surface 120 of the second section 12 of the heat sink 10. In order to fix the semiconductor light source module 1 to the support 3, two further screws 6 are provided, are inserted into screw holes on the rear side 122 of the second, plate-like section 12 of the heat sink 10 and are screwed together with corresponding screw holes in the support 3. In addition, on the rear side 122 of the second, plate-like section 12 of the heat sink 10 there is arranged a socket 7, which contains the electric contacts for the power supply of the semiconductor light source module 1 and is provided to receive a plug. Via the socket 7, the semiconductor light source module 1 is supplied with the on-board power supply of the motor vehicle. Furthermore, on the rear side 32 of the support 3 there are arranged three fixing means 8 projecting beyond the side edges of the support 3, which are used to mount the lighting device in a motor vehicle.

To replace the semiconductor light source module 1, the screws 5 and 6 on the rear side 122 of the second, plate-like section 12 of the heat sink 10 of the semiconductor light source module 1 are loosened. As a result, the semiconductor light source module 1 can be taken off the rear side 32 of the support 3, by being pulled off of the second sections 232 of the dowels 23 that extend into the holes 121. Following the removal of the screws 5 and of the semiconductor light source module 1, the optical unit 2 is still adequately fixed to the support 3 by means of the snap-in hooks 24 and the dowels 23 sticking into the apertures 34, so that said unit cannot become detached from the support 3. The mounting of the new semiconductor light source module 1 is carried out in the opposite order to that of the disassembly.

The present disclosure is not restricted to the exemplary embodiment described in detail above. For example, the semiconductor light source module 1 can additionally have a primary optical unit, which is arranged immediately above the light-emitting diode chips 40 and deflects the light emitted by the light-emitting diode chips 40 onto the light-reflecting inner side 21 of the optical unit 2. This primary optical unit can be, for example, an optical lens or an optical concentrator. The semiconductor light sources of the semiconductor light source module 1 can also have other light sources, such as, e.g., superluminescent diodes or laser diodes, instead of the light-emitting diode chips 40. In addition, the optical unit 2 can also have shapes other than the shell-like one according to the preferred embodiment. Furthermore, the light-reflecting surface 21 of the optical unit can be partly or completely coated with fluorescent material.

Furthermore, the dowels 23 of the optical unit 2 do not necessarily have to be designed to be hollow. Instead, the second sections 232 of the dowels 23 can be formed in such a way that they project through the corresponding hole 121 in the second section 12 of the heat sink 10 of the semiconductor light source module 1, and that the part of the second section 232 of the dowels that projects out on the rear side 122 of the heat sink 10 has a screw thread, onto which a nut can be screwed in order to screw the semiconductor light source module 1 to the optical unit 2.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, comprising:

a semiconductor light source module, an optical unit and a common support for the semiconductor light source module and the optical unit, wherein the optical unit is mounted on a front side of the support and has at least one dowel, which extends into a precisely fitting hole in the semiconductor light source module, wherein the semiconductor light source module rests on a rear side of the support, opposite the front side, the at least one dowel projects through an aperture in the support and extends into the precisely fitting hole in the semiconductor light source module, and the at least one dowel forms a shoulder, which rests on a supporting surface of the semiconductor light source module that rests on the rear side of the support.

2. The lighting device as claimed in claim 1, wherein the at least one dowel is formed in one piece with the optical unit.

3. The lighting device as claimed in claim 1, wherein the at least one dowel is designed to be hollow and has a screw thread to receive a screw.

4. The lighting device as claimed in claim 1, wherein the at least one dowel projects out of the precisely fitting hole in the semiconductor light source module, out of a side of the semiconductor light source module that faces away from the supporting surface, and the section of the dowel projecting out of the hole in the semiconductor light source module is provided with a screw thread for a nut.

5. The lighting device as claimed in claim 1, wherein first fixing means are provided in order to fix the supporting surface of the semiconductor light source module to the rear side of the support.

6. The lighting device as claimed in claim 1, wherein there are second fixing means for fixing the optical unit to the support.

7. The lighting device as claimed in claim 6, wherein the second fixing means are formed as a latching or snap-in connection between optical unit and support.

8. The lighting device as claimed in claim 1, wherein the support has a cutout to receive a section of the semiconductor light source module that is provided with semiconductor light sources.

9. The lighting device as claimed in claim 1, wherein the support is formed as a cooling element.

10. The lighting device as claimed in claim 8, wherein the semiconductor light source module has a heat sink, and wherein the supporting surface is formed as a constituent part of the heat sink, and the semiconductor light sources are arranged on the heat sink.

11. The lighting device as claimed in claim 2, wherein the at least one dowel is hollow and has a screw thread to receive a screw.

12. The lighting device as claimed in claim 2, wherein the at least one dowel projects out of the precisely fitting hole in the semiconductor light source module, out of a side of the semiconductor light source module that faces away from the supporting surface, and the section of the dowel projecting out of the hole in the semiconductor light source module is provided with a screw thread for a nut.

* * * * *